US006668695B2

(12) United States Patent
Poole et al.

(10) Patent No.: US 6,668,695 B2
(45) Date of Patent: Dec. 30, 2003

(54) CLAMPING SYSTEM

(76) Inventors: Daniel L. Poole, 3319 W. Malapai Dr., Phoenix, AZ (US) 85051; Robert N. Poole, 260 Bluegrass Ranch Rd., Pinetop, AZ (US) 85935

( * ) Notice: Subject to any disclaimer, the term of this patent is extended or adjusted under 35 U.S.C. 154(b) by 169 days.

(21) Appl. No.: 09/996,055

(22) Filed: Nov. 28, 2001

(65) Prior Publication Data

US 2002/0035909 A1 Mar. 28, 2002

Related U.S. Application Data

(60) Continuation of application No. 09/422,017, filed on Oct. 21, 1999, which is a division of application No. 09/047,241, filed on Mar. 24, 1998, now abandoned.

(60) Provisional application No. 60/041,717, filed on Mar. 27, 1997.

(51) Int. Cl.[7] ..... B26D 7/02

(52) U.S. Cl. ..... 83/466; 83/454; 83/463; 83/464; 83/762; 269/283; 269/305

(58) Field of Search ..... 269/305, 236, 269/235, 231, 900, 283; 83/767, 454, 466, 762, 463, 464, 452, 698.71, 699.31, 698.11; D8/71, 72

(56) References Cited

U.S. PATENT DOCUMENTS

| | | | | | |
|---|---|---|---|---|---|
| 406,828 | A | * | 7/1889 | Fietsch, Jr. | 269/900 X |
| 724,116 | A | * | 3/1903 | Maley | 269/900 X |
| 1,184,732 | A | * | 5/1916 | Fisk | 83/767 |
| 2,430,613 | A | * | 11/1947 | Hodge | 269/231 X |
| 2,621,807 | A | * | 12/1952 | Rendich | 269/900 X |
| 3,188,078 | A | * | 6/1965 | Peterson | 269/305 X |
| 3,397,722 | A | * | 8/1968 | Long | 83/762 |
| 3,622,145 | A | * | 11/1971 | Gibson | 269/305 X |
| 4,157,819 | A | * | 6/1979 | Meyer | 269/231 |
| 4,298,195 | A | * | 11/1981 | McDougal | 269/305 X |
| 4,625,951 | A | * | 12/1986 | Yang | 269/900 X |
| 4,901,990 | A | * | 2/1990 | Frechette | 269/305 X |
| 4,964,327 | A | * | 10/1990 | Nolan et al. | 269/231 X |
| 5,129,637 | A | * | 7/1992 | Ito et al. | 269/235 X |
| 5,135,036 | A | * | 8/1992 | Caron | 269/305 X |
| 5,419,540 | A | * | 5/1995 | Teafatiller | 269/283 X |
| 5,538,231 | A | * | 7/1996 | Baldwin et al. | 269/900 X |
| 5,560,273 | A | * | 10/1996 | Keddie | 83/767 |
| 5,732,937 | A | * | 3/1998 | Morghen | 269/305 X |
| D406,035 | S | * | 2/1999 | Erisoty et al. | D8/71 |
| 5,957,023 | A | * | 9/1999 | Cheng | 83/767 X |
| 6,202,530 | B1 | * | 3/2001 | Cawley | 83/452 X |
| 6,325,263 | B1 | * | 12/2001 | De Dompierre et al. | 83/699.31 X |

* cited by examiner

*Primary Examiner*—Charles Goodman
(74) *Attorney, Agent, or Firm*—Parsons & Goltry; Robert A. Parsons; Michael W. Goltry

(57) ABSTRACT

A clamping miter box including a base having a surface, a plurality of holes positioned in a pattern in the surface of the base, and a cam peg including a shaft sized to be rotatably receivable by a selected one of the plurality of holes and a cam portion coupled to the shaft for rotation therewith. The cam portion for engaging the item to be clamped.

2 Claims, 4 Drawing Sheets

FIG. 1
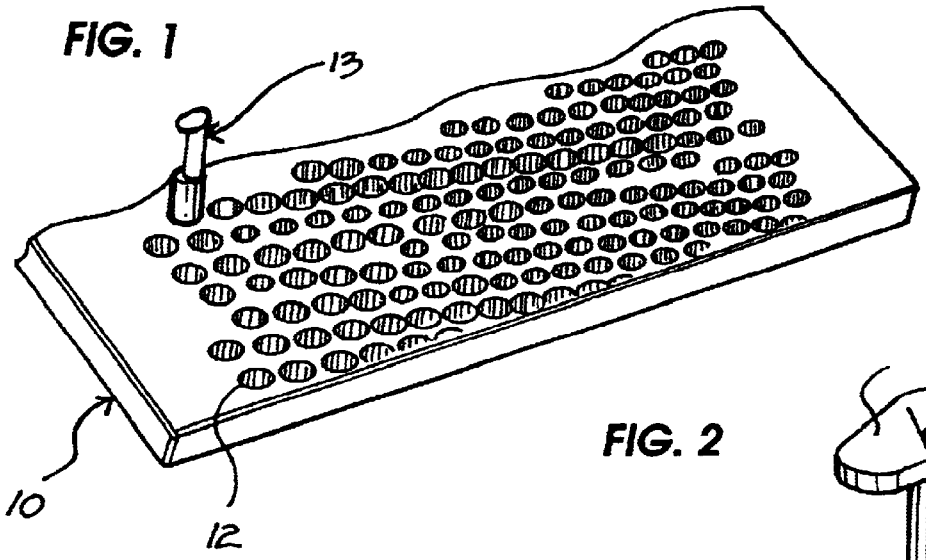
FIG. 2
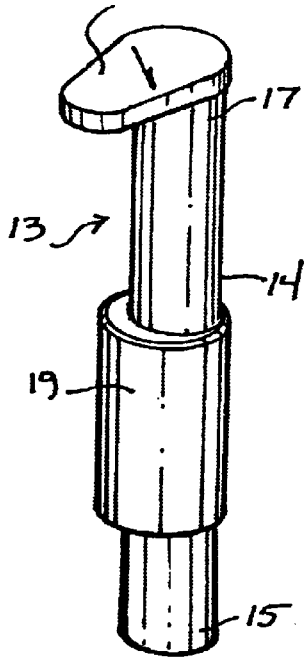
FIG. 3
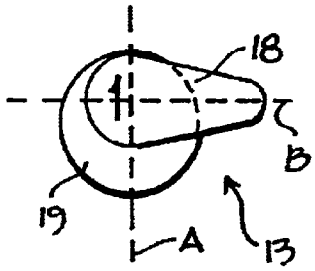
FIG. 4
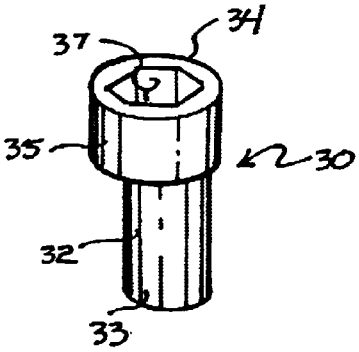
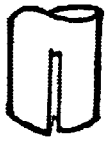
FIG. 6
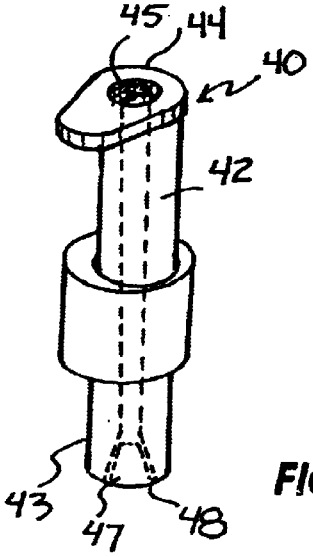
FIG. 5
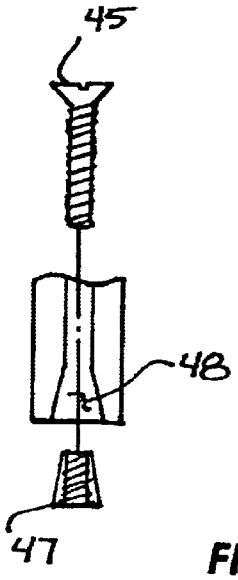
FIG. 7

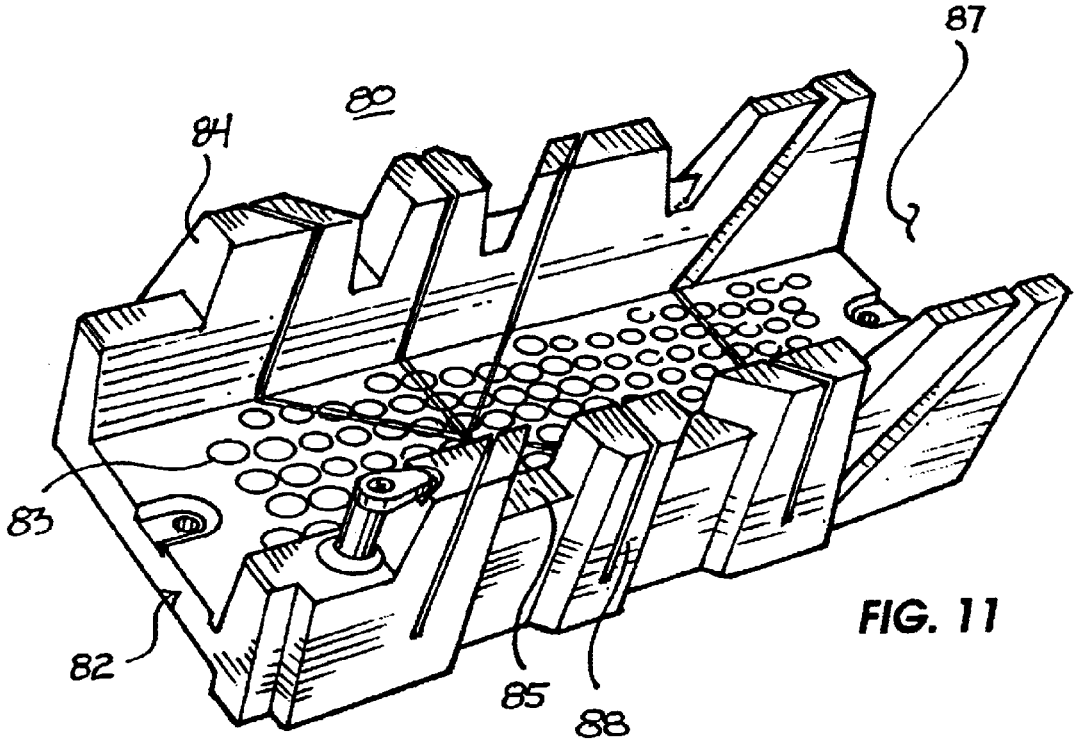
FIG. 11
FIG. 12
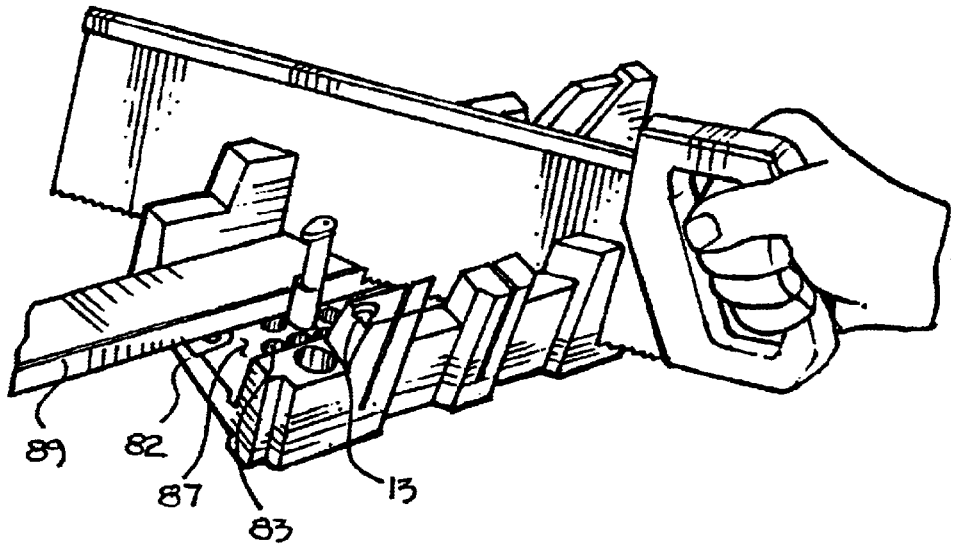

CLAMPING SYSTEM

This application is a continuation application of U.S. patent application Ser. No. 09/422,017, filed Oct. 21, 1999, which is a divisional application of U.S. patent application Ser. No. 09/047,241, filed Mar. 24, 1998, now abandoned, which claimed the benefit of U.S. Provisional Application serial No. 60/041,717, filed Mar. 27, 1997, now expired.

FIELD OF THE INVENTION

The present invention pertains to clamping devices, and more specifically to clamping devices which are infinitely adjustable.

BACKGROUND OF THE INVENTION

Clamps are well known and have long been used in a wide variety of industries and private workshops. A clamp is designed to bind or constrict or to press two or more parts together so as to hold them firmly. Many clamps, such as C-clamps, can clamp two items together or hold an item to a surface to be worked on. One drawback with this type of clamp is that in order to clamp an item on a surface, the surface must have an accessible edge. Thus, while the surface may be large, only the exposed edges can be used for clamping. Furthermore, many clamping devices are large and unwieldy, possibly obstructing work on the clamped item. For example, an item clamped to the surface of a work bench cannot easily be sanded because the clamp most probably projects past the surface to be sanded. Many attempts have been made to incorporate a clamp into a workbench or a tool, such as a drill press or miter box, with little success.

Accordingly, it is highly desirable to provide a new and improved clamping system.

It is an object of the present invention to provide a new and improved clamping system which is infinitely adjustable.

It is another object of the present invention to provide a clamping system which can be incorporated into a work bench or tools.

It is a further object of the present invention to provide a new and improved clamping system which can clamp irregular shaped items.

It is a further object of the present invention to provide a new and improved clamping system which allows clamping of an item to a surface.

SUMMARY OF THE INVENTION

The above problems and others are at least partially solved and the above purposes and others are realized in a clamp apparatus including a base having a surface, a plurality of holes positioned in a pattern in the surface of the base, and a cam peg including a shaft sized to be rotatably receivable by a selected one of the plurality of holes and a cam portion coupled to the shaft for rotation therewith. The cam portion is adapted to engage an item to be clamped on the base.

In more specific embodiments, the cam peg includes a rotation facilitating member which can be a grip or a tool receiving opening in an upper end of the shaft. In addition a locking mechanism can be affixed to the shaft for locking the cam peg within the selected one of the plurality of holes.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which:

FIG. 1 is a partial view of the clamp apparatus according to the present invention;

FIG. 2 is a perspective view of a cam peg according to the present invention;

FIG. 3 is a top view of the cam peg of FIG. 2;

FIG. 4 is a perspective view of another embodiment of a cam peg;

FIG. 5 is a perspective view of a cam peg with locking mechanism;

FIG. 6 is a view of the end of the cam peg of FIG. 5;

FIG. 7 is an exploded view of the locking mechanism of the cam peg of FIG. 5;

FIG. 11 is a perspective view illustrating a miter box employing the clamping apparatus according to the present invention; and FIG. 12 is a perspective view illustrating an item clamped in the miter box of FIG. 11, employing the clamping apparatus according to the present invention.

DETAILED DESCRIPTION OF THE PREFERRED EMBODIMENT

Figure 8:
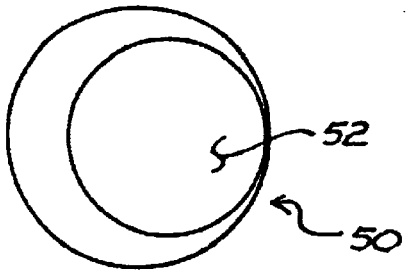
FIG. 8 is a top view of a cam washer.

Turning now to the drawings in which like reference characters indicate corresponding elements throughout the several views, attention is first directed to FIG. 1 which illustrates a clamping system including a base 10, in which is formed a plurality of holes 12 (not drawn to correct positions), and cam pegs 13 of which only one is illustrated. It will be understood that only a portion of base 10 is illustrated and that base 10 may be substantially any dimensions as desired. Furthermore, the proper positioning of holes 12 is important to the invention and will be described in detail. Base 10 can be incorporated into or onto substantially any surface to provide clamping capability. For example, a work bench can be surfaced with a plurality of interconnecting bases 10 to incorporate the clamping system on a portion of or over the entire surface. The present invention can also be incorporated with tools such as drill presses by replacing or covering the base of the drill press with a base similar to base 10.

Turning now to FIG. 2, cam peg 13 is illustrated. Cam peg 13 includes a shaft 14 with a diameter slightly smaller than the diameter of holes 12 to allow insertion of pegs 13 therein. Shaft 14 includes an end 15 for insertion into holes 12 and an opposing end 17 having a grip 18 for facilitating rotation of cam peg 13 within holes 12. A cam portion 19 is formed on shaft 14 intermediate ends 15 and 17. As can be seen with further reference to FIG. 3, cam portion 19 has a diameter greater than the diameter of shaft 14 and holes 12, and is offset with respect to shaft 14 along line A in FIG. 3. Cam portion 19 is offset so that its outer diameter is flush with shaft 14 on one side and extends outward from shaft 14 on an opposing side. Grip 18 extends outward from shaft 14 along a line B, generally perpendicular to line A. In other areas grip 18 is flush with shaft 14. While not critical to the invention, the orientation of grip 18 with respect to cam portion 19 facilitates inserting and rotating peg 13 when adjacent an upright surface as will be described presently.

With reference to FIG. 4, another embodiment of a cam peg, generally designated 30, is illustrated. Cam peg 30 includes a shaft 32 with a diameter slightly smaller than the diameter of holes 12 to allow insertion of pegs 30 therein. Shaft 32 includes an end 33 for insertion into holes 12 and an opposing end 34. A cam portion 35 is formed on shaft 14 proximate end 34. As with cam portion 19, cam portion 35 has a diameter greater than the diameter of shaft 32 and holes 12, and is offset with respect to shaft 32. Cam portion 35 is offset so that its outer diameter is flush with shaft 32 on one side and extends outward from shaft 32 on an opposing side. End 34 further includes a socket 37 formed therein for receiving a tool such as an allen wrench to facilitate rotation of peg 30 within holes 12.

A further embodiment of a cam peg, generally designated 40, is illustrated in FIGS. 5–7. Peg 40 is generally similar to peg 13, including a shaft 42 having an end 43 and opposing end 44, but can be locked into holes 12 by rotating a screw 45 extending the length of shaft 42. End 43 is split to allow outward expansion thereof as illustrated in FIG. 6. With additional reference to FIG. 7, a tapered expansion member 47 is carried within a tapered chamber 48 formed in end 43 and threadably receives the end of screw 45. As screw 45 is tightened, tapered expansion member 47 is pulled toward end 44, forcing end 43 to expand outward. In this manner a peg can be locked into a hole 12. It should be understood that while a cam peg is illustrated, the locking feature can be used on any peg or accessory. For example a straight peg can also be provided with a locking feature. Also, pegs may vary in length as desired.

Turning now to FIG. 8, it may be desirable to enlarge the cam of cam pegs 13, 30, and 40 etc. Thus, a cam washer 50 is provided which includes a bore 52 sized and shaped to receive, for example, cam portion 19 of cam peg 13 therein. In this manner a larger cam is provided for purposes which will be discussed presently.

Figure 9:
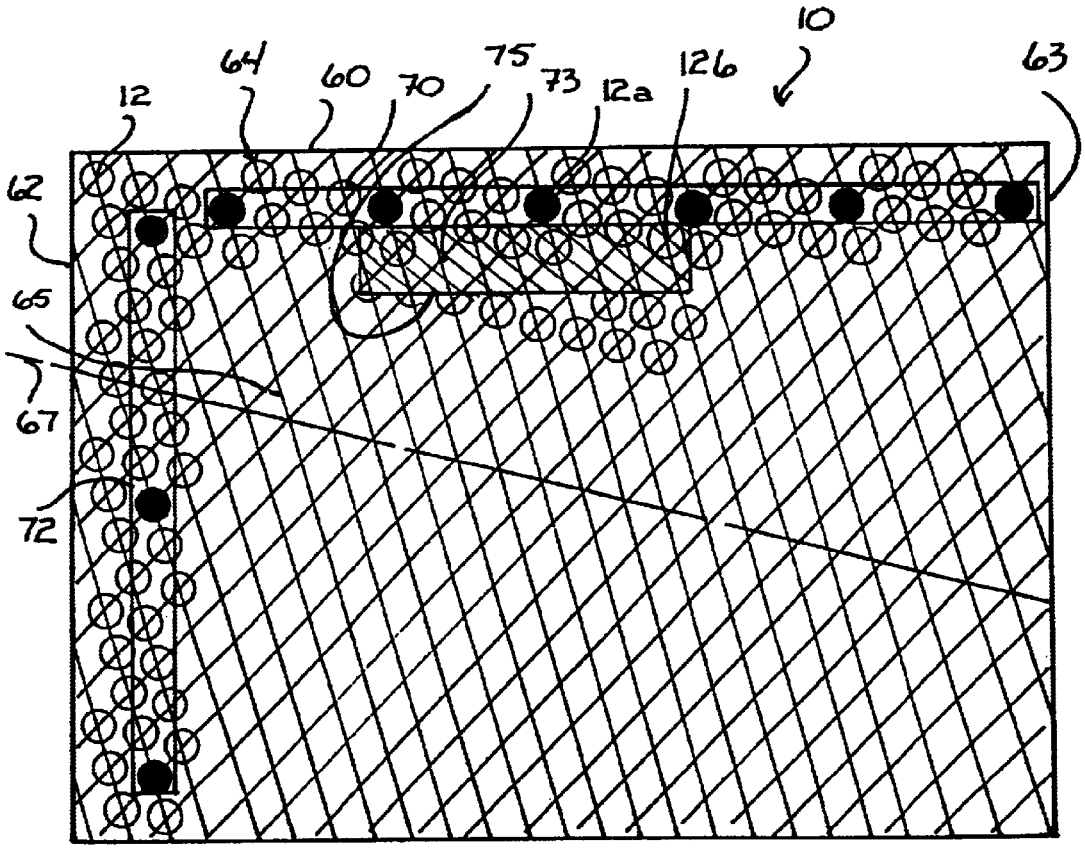
FIG. 9 is a top plan of the base of the clamping apparatus illustrating a hole pattern.
Figure 10:
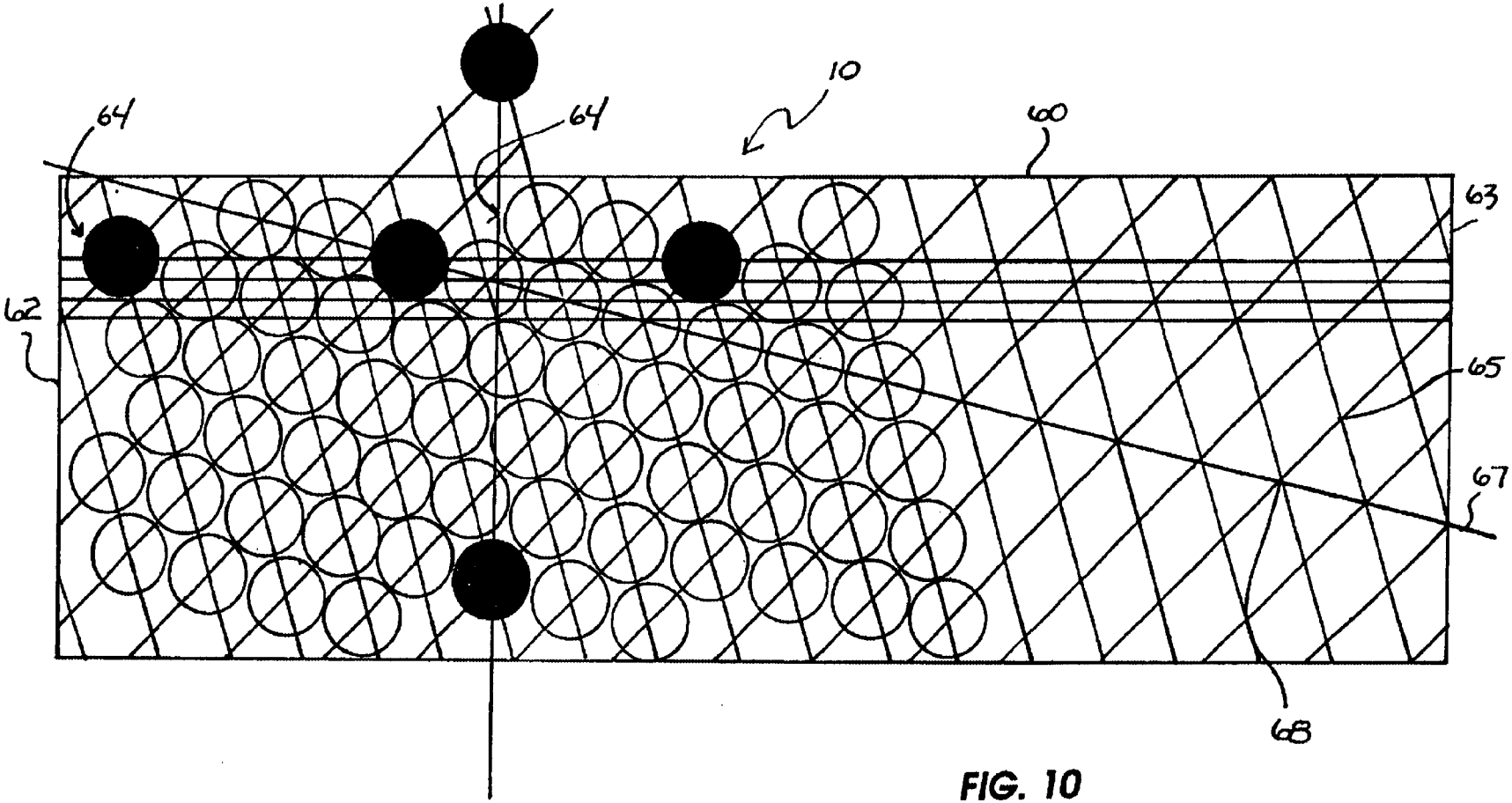
FIG. 10 illustrates an enlarged portion of the base of FIG. 9.

Turning now to FIG. 9, a top plan of base 10 is illustrated with a portion of holes 12 shown, and a grid of lines. The grid of lines illustrates the positions of holes 12 wherein intersections 65 of the lines designate where the center of each hole 12 is located. For purposes of orientation and to aid in the description, base 10 includes an upper edge 60, left edge 62 and right edge 63. Holes 12 are aligned in a plurality of slanted rows 64 which extend at an angle to upper edge 60. With additional reference to FIG. 10 which illustrates an enlarged portion of base 10 of FIG. 9, slanted rows 64 are formed at approximately a fourteen degree angle with respect to an orientation line such as upper edge 60. Furthermore, each slanted row 64 is offset with respect to adjacent slanted rows. An example of a method to determine the location of holes 12, is to draw a line 67 at a fourteen degree angle with respect to upper edge 60. A mark 68 is made every nine-sixteenths of an inch. As will be discussed below, this distance will vary depending on the diameter of and distance between holes 12. Then the grid is drawn with lines intersecting marks 68 and being at thirty degree angles with respect to slanted line 67. In this specific example, holes 12 have a diameter of approximately one-half of an inch and are approximately one-sixteenth of an inch apart. At their closest point, holes 12 are approximately one-sixteenth of an inch apart. Also, the centers of holes 12 in adjacent slanted rows 64 are approximately nine-sixteenths of an inch apart. It will be understood that the size of holes 12 can be increased or decreased as desired, in which case the distance between marks must also be adjusted. It should also be noted, that while fourteen degrees is the preferred angle of slanted rows 64, other angles can also be employed, such as eleven degrees, sixteen degrees, and nineteen degrees. In each instance holes will align in adjacent rows 64, but the vertical and horizontal distance between will vary.

Slanted rows 64 are formed because holes 12 will align vertically and horizontally a given distance apart, as illustrated by the blackened holes. With reference back to FIG. 9, the alignment of holes 12 permits stops 70 and 72 to be secured on base 10 by pegs extending therefrom and received in the aligned holes 12. These stops can be positioned anywhere on base 10, and act to anchor an object. To clamp the object, cam pegs 13, 30, 40, etc. are used. An item 73 is shown abutting stop 70. To clamp item 73 into position, the correct holes 12 must be selected, in this case designated 12*a* and 12*b*. Due to the slanted and staggered alignment of holes 12, there will always be a hole which is completely uncovered and which will receive a peg. By using camming pegs, such as peg 13, item 73 can be tightened against stop 70 by rotating shaft 14 to bring cam portion 19 against a surface 75 thereof and to tighten as needed. When rotated, peg 13 will remain at the new orientation due to the pressure exerted against cam portion 19. The pressure between item 73 and cam portion 19 binds shaft 14 within hole 12. The off-centered nature of cam portion 19 permits holes 12 to be used which are a slight distance from the surface to be contacted. If an individual desires to use a hole further from the surface to be contact, cam washer 50 can be used.

It should be understood that the possible combinations of holes and pegs are endless in the present invention. For example, straight pegs, camming pegs or multiple peg stops may be used in combination. Typically, these pegs extend upward past the top surface of the item to be held. This may, however pose a problem for certain activities such as sanding the top surface of a board. In this instance cam peg 30 can be employed. End 34 of peg 30 will be below the level of the top surface to permit unobstructed sanding. It should also be understood that irregularly shaped objects can also be clamped to base 10 simply by using different combinations of pegs, and finding the appropriate holes 12.

Turning now to FIG. 11, a specific example of a use of the clamping system of the present invention is illustrated. In this specific example, the clamp system is incorporated into a miter box generally designated 80. Miter box 80 includes a base 82 having a plurality of holes 83 formed therein in an orientation as described previously, upright sidewalls 84 and 85 extending upward from opposing edges of base 82 to define a channel 87 overlying base 82, and slots 88 formed in sidewalls 84 and 85 for guiding a cutting blade.

In a conventional miter box, a molding or like article is placed between upright sidewalls, and held firmly against one of the sidewalls by hand to prevent movement of the board during the cutting operation, and to insure that the cut is made at the desired angle. This, however, can be less than satisfactory for safety reasons and quality of cut. With additional reference to FIG. 12, miter box 80 is employed to aid in making a cut having a specific angle on a molding 89. Miter box 80 avoids the problems of conventional miter boxes by incorporating the novel clamp system of the present invention. Molding 89 is positioned in channel 87 on base 82 with one side abutting sidewall 84. Cam peg 13 is inserted into one of the plurality of holes 83 which is fully uncovered by molding 89. Peg 13 is rotated bringing cam portion 19 against a surface of molding 89. Peg 13 is rotated until molding 89 is clamped against sidewall 84 with the desired force. Peg 13 remains in this orientation due to the force between molding 89 and peg 13 binding shaft 14 to the sides of hole 83. One or more pegs 13 may be employed, although only one is illustrated. Molding 89 can be cut without any movement. Pegs 13 are easily released by rotating them in the opposite direction.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

What is claimed is:

1. A clamping miter box comprising:

a base having a surface, and two opposed sidewalls extending from opposite sides of the base and, at least one of the sidewalls defining a reference line, and each of the two sidewalls having a plurality of mating saw-receiving slots therein for positioning a saw at different angles relative to the reference line for mitering a work piece;

a plurality of holes positioned in a pattern in the surface of the base wherein the pattern is oriented with respect to the reference line and the plurality of holes are positioned in a plurality of rows, a plurality of first columns and a plurality of second columns with each row of the plurality of rows being at a first angle greater than zero degrees and less than ninety degrees to the reference line and offset with respect to an adjacent row of the plurality of rows, each column of the plurality of first columns being at a second angle greater than zero degrees and less than ninety degrees to the reference line, and each column of the plurality of second columns being at a third angle greater than ninety degrees and less than one hundred and eighty degrees to the reference line so as to form periodic groupings of holes, each grouping of the periodic groupings having each hole in the grouping in a different row from other holes in the grouping, the groupings being aligned along a line parallel to or perpendicular to the reference line with each grouping being spaced from adjacent groupings by a selected distance; and a cam peg receivable by a selected one of the plurality of holes, the cam peg including a smooth shaft portion adjacent one end formed to be rotatably received in one of the plurality of holes and a cam portion extending horizontally beyond the smooth shaft portion for a portion of a circumference of the smooth shaft portion, the work piece to be mitered being at least one shaft portion width smaller than a distance between the two sidewalls and the plurality of holes and the cam peg being further constructed and positioned so that the work piece to be mitered can be positioned on the surface of the base and clamped against one of the sidewalls by the cam portion of the cam peg rotatably engaged in an exposed one of the plurality of holes.

2. A clamping miter box comprising:

a base having a surface with a width and a length, and a sidewall extending upwardly from the base along the length;

a plurality of holes positioned in a pattern in the surface of the base wherein the pattern includes a reference line with which the pattern is oriented, the reference line is defined by the side extending from the base and the plurality of holes are positioned in a plurality of rows, a plurality of first columns and a plurality of second columns, with each row of the plurality of rows being at a first angle greater than zero degrees and less than ninety degrees to the reference line and offset with respect to an adjacent row of the plurality of rows, each column of the plurality of first columns being at a second angle greater than zero degrees and less than ninety degrees to the reference line, and each column of the plurality of second columns being at a third angle greater than ninety degrees and less than one hundred and eighty degrees to the reference line so as to form periodic groupings of holes, each grouping of the periodic groupings having each hole in the grouping in a different row from other holes in the grouping, the groupings being aligned along a line parallel to or perpendicular to the reference line with each grouping being spaced from adjacent groupings by a selected distance;

a plurality of cam pegs, each including a smooth shaft sized to be rotatably receivable by a selected one of the plurality of holes and a cam portion coupled to the shaft for rotation therewith, the cam portion extending horizontally beyond the smooth shaft for a portion of a circumference of the smooth shaft, the cam portion for engaging an item to be clamped on the base; and wherein the item to be clamped has a width less than the width of the surface and is positioned on the surface of the base so as to expose at least one of the plurality of holes, and at least one of the plurality of cam pegs is receivable within the exposed at least one of the plurality of holes adjacent the item to be clamped and the at least one of the plurality of cam pegs is rotateable to engage the item to be clamped with the cam portion.

* * * * *